US008983323B2

(12) United States Patent
Yamashita et al.

(10) Patent No.: US 8,983,323 B2
(45) Date of Patent: Mar. 17, 2015

(54) COLOR IMAGE FORMING APPARATUS WITH A LINE VELOCITY DIFFERENCE SET BETWEEN IMAGE CARRIERS

(71) Applicants: Takeshi Yamashita, Osaka (JP); Yuji Nagatomo, Osaka (JP); Naoki Nakatake, Hyogo (JP); Yasuhiro Fujiwara, Osaka (JP); Takafumi Miyazaki, Osaka (JP); Yasuhide Matsuno, Osaka (JP); Takahiro Sanada, Osaka (JP); Rumi Miyazaki, Osaka (JP); Kyoko Abe, Osaka (JP); Tomoya Adachi, Hyogo (JP); Yoshie Iwakura, Osaka (JP)

(72) Inventors: Takeshi Yamashita, Osaka (JP); Yuji Nagatomo, Osaka (JP); Naoki Nakatake, Hyogo (JP); Yasuhiro Fujiwara, Osaka (JP); Takafumi Miyazaki, Osaka (JP); Yasuhide Matsuno, Osaka (JP); Takahiro Sanada, Osaka (JP); Rumi Miyazaki, Osaka (JP); Kyoko Abe, Osaka (JP); Tomoya Adachi, Hyogo (JP); Yoshie Iwakura, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 13 days.

(21) Appl. No.: 13/749,897

(22) Filed: Jan. 25, 2013

(65) Prior Publication Data

US 2013/0195487 A1 Aug. 1, 2013

(30) Foreign Application Priority Data

Jan. 27, 2012 (JP) ..... 2012-015462

(51) Int. Cl.
*G03G 15/16* (2006.01)
*G03G 15/14* (2006.01)
(Continued)

(52) U.S. Cl.
CPC ..... *G03G 15/14* (2013.01); *G03G 15/0189* (2013.01); *G03G 15/1615* (2013.01); *G03G 15/5008* (2013.01)
USPC ..... 399/66; 399/236

(58) Field of Classification Search
CPC ..... G03G 15/1675; G03G 15/09
USPC ..... 399/66, 236
See application file for complete search history.

(56) References Cited

U.S. PATENT DOCUMENTS 6,122,475 A 9/2000 Seto et al.
7,317,889 B2 * 1/2008 Suzuki ..... 399/236
(Continued)

FOREIGN PATENT DOCUMENTS

JP 07-181747 7/1995
JP 11-282289 10/1999
(Continued)

OTHER PUBLICATIONS

English Translation of Matayoshi, Akira. Image Forming Apparatus, Jun. 2, 2005, Japanese Patent Office. JP2005-141108.*
(Continued)

*Primary Examiner* — Clayton E Laballe
*Assistant Examiner* — Trevor J Bervik
(74) *Attorney, Agent, or Firm* — Harness, Dickey & Pierce, P.L.C.

(57) ABSTRACT

Provided is a color image forming apparatus that includes: image carriers that form toner image of black and other colors; an intermediate transfer body that makes contact with the image carriers; and transfer units that transfer the toner images on the image carriers to the intermediate transfer body. A line velocity difference is set between the image carriers and the intermediate transfer body. An accelerated cohesion degree of toner is equal to or larger than 54%. A linear velocity difference $X_1$ between the image carrier for black and the intermediate transfer body satisfies a relation of $0<X_1\leq 1.2$ mm/sec. A linear velocity difference $X_2$ between the image carriers for the colors and the intermediate transfer body satisfies a relation of $2.1\leq X_2\leq 4.0$ mm/sec.

10 Claims, 5 Drawing Sheets

(51) Int. Cl.
*G03G 15/01* (2006.01)
*G03G 15/00* (2006.01)

(56) References Cited

U.S. PATENT DOCUMENTS

| | | | | |
|---|---|---|---|---|
| 7,844,191 | B2 * | 11/2010 | Endou et al. | 399/66 |
| 7,848,687 | B2 * | 12/2010 | Iwasaki | 399/301 |
| 8,036,550 | B2 * | 10/2011 | Minbu | 399/45 |
| 2008/0038017 | A1 | 2/2008 | Fujita et al. | |
| 2008/0131168 | A1 * | 6/2008 | Ehara et al. | 399/167 |
| 2008/0220362 | A1 * | 9/2008 | Moore et al. | 430/113 |
| 2009/0041491 | A1 | 2/2009 | Shono et al. | |
| 2009/0180791 | A1 | 7/2009 | Matsushita et al. | |
| 2009/0214241 | A1 * | 8/2009 | Kawaguchi et al. | 399/66 |
| 2010/0329703 | A1 * | 12/2010 | Ozeki | 399/27 |
| 2011/0135347 | A1 * | 6/2011 | Takishita | 399/297 |

FOREIGN PATENT DOCUMENTS

| | | | |
|---|---|---|---|
| JP | 2001-117317 | | 4/2001 |
| JP | 2002-258523 | | 9/2002 |
| JP | 2003-057916 | | 2/2003 |
| JP | 2005141108 | A * | 6/2005 |
| JP | 2005-234393 | | 9/2005 |
| JP | 2007-304405 | | 11/2007 |
| JP | 2008-058486 | | 3/2008 |

OTHER PUBLICATIONS

English Translation of Yoshida, Ken. Color Image Forming Apparagus, Nov. 22, 2007, Japanese Patent Office. JP2007-304405.*

* cited by examiner

FIG.7

| | LINEAR VELOCITY OF PHOTO-SENSITIVE DRUM [mm/sec] | SURFACE RESIS-TIVITY OF BELT [Ω/SQUARE] | PRIMARY TRANS-FER BIAS [V] | PRIMARY TRANS-FER PUSHING FORCE [N] | TRANS-FER HOLLOW EVALU-ATION RESULTS | BELT ABRASION EVALU-ATION RESULTS | COMPRE-HENSIVE EVALU-ATION RESULTS |
|---|---|---|---|---|---|---|---|
| EXAMPLE 1 | TEMPO-RALLY CHANGE * | $3.0 \times 10^{10}$ | 1100 | 17 | PASS | PASS | PASS |
| COMPAR-ATIVE EXAMPLE 1 | 140 | $3.0 \times 10^{10}$ | 1100 | 17 | FAIL | PASS | FAIL |
| COMPAR-ATIVE EXAMPLE 2 | 136 | $3.0 \times 10^{10}$ | 1100 | 17 | PASS | FAIL | FAIL |
| COMPAR-ATIVE EXAMPLE 3 | TEMPO-RALLY CHANGE * | $3.0 \times 10^{10}$ | 1100 | 27 | FAIL | PASS | FAIL |

* LINEAR VELOCITY IS REDUCED STEP BY STEP IN ACCORDANCE WITH INCREASE IN RUNNING DISTANCE OF PHOTOSENSITIVE DRUM AS ILLUSTRATED IN FIG. 6

FIG.8

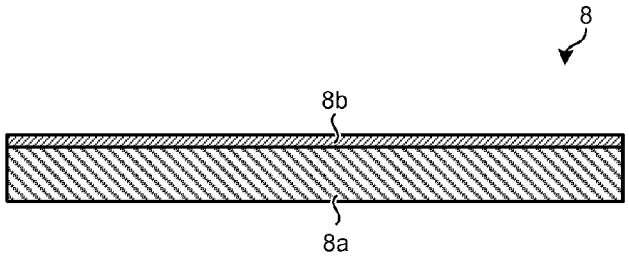

COLOR IMAGE FORMING APPARATUS WITH A LINE VELOCITY DIFFERENCE SET BETWEEN IMAGE CARRIERS

CROSS-REFERENCE TO RELATED APPLICATIONS

The present application claims priority to and incorporates by reference the entire contents of Japanese Patent Application No. 2012-015462 filed in Japan on Jan. 27, 2012.

BACKGROUND OF THE INVENTION

1. Field of the Invention

The present invention relates to a color image forming apparatus.

2. Description of the Related Art

Electrophotographic color image forming apparatuses have been widely used in the fields of small offices and general personal users. The color image forming apparatuses used in such fields are required to be more downsized, to have longer operating lives, and to further reduce costs than large color image forming apparatuses used in business or industrial purposes.

When such a color image forming apparatus is designed to meet the requirements of downsizing, longer operating life, and cost reduction, particularly a layout of functional parts needs to be examined in designing a photosensitive element serving as an image carrier and its peripheral parts, for example. For the downsizing of the photosensitive element, it is required to downsize a charging unit, a developing unit, a transfer unit, and a cleaning unit arranged adjacent to the photosensitive element as peripheral units in addition to the downsizing of the appropriate photosensitive element. However, it is difficult to downsize such peripheral parts because they are functional parts. The layout design has been elaborated to downsize the peripheral parts, but downsizing in such a way has come close to the limitation.

A lubricant applying member is one of the peripheral parts and applies lubricant on a surface of the photosensitive element. The lubricant applying member reduces abrasion of the photosensitive element caused by friction. Recently, rather than using the lubricant applying member, a lubricating component such as silicone oil is added to toner as an external additive to reduce friction on the surface of the photosensitive element. The use of such toner containing the lubricating component can eliminate the lubricant applying member, thereby achieving a low cost and further increasing flexibility of a layout of the functional parts arranged around the photosensitive element. As a result, the image forming apparatus is readily downsized.

In addition to the photosensitive element, other functional parts such as a developing roller have been advanced in downsizing, a longer operating life, and a cost reduction. As a recent trend, running costs have been lowered progressively by increasing durability of the functional parts including the developing roller in a process unit and thereby reducing frequency of replacement of the functional parts by a user.

With an extended operating life of the process unit, a space is newly needed in the process unit to store toner required in the increased operating life. This increases the size of the process unit, and thereby increasing the size of the image forming apparatus.

In view of such problems, a cartridge supplying technique has been proposed in which the amount of toner contained in the process unit is reduced and a toner cartridge compensates for a shortage. The cartridge supplying technique can achieve both of the downsizing and cost reduction of the image forming apparatus because a large amount of toner is not required to be contained in the cartridge; and a user replaces a used cartridge with a new cartridge each time toner is nearly exhausted.

The toner to which the lubricating component is added has increased adhering force between toner particles, thereby causing fluidity of the toner to deteriorate. In addition, the toner receives stress due to contact friction when the toner sequentially passes through a supply roller, a developing roller, a regulating blade, and a photosensitive element while making contact with them in the printing operation. The stress due to the friction causes: the lubricative external additive of the toner to come off; the lubricative external additive to be buried in the surfaces of the toner particles; or the toner particles to be broken or deformed.

Accordingly, the stress not only reduces the charged potential of the toner but also causes the toner to be readily broken with the deterioration of the fluidity of the toner. As a result, a transfer hollow phenomenon (what is called a "vermiculation phenomenon") may occur. In the transfer hollow phenomenon, toner is not fully transferred from the photosensitive element to an intermediate transfer belt in a primary transfer area between a photosensitive drum and the intermediate transfer belt, resulting in central areas of images (particularly, central areas of lines or characters) on the intermediate transfer belt being missing.

Japanese Patent Application Laid-open No. 2003-57916 discloses that a circumferential speed of an intermediate transfer belt is set faster (0.1%) or slower (0.1%) than the circumferential speed of any of a plurality of photosensitive drums in transferring operation for the purpose of preventing the transfer hollow.

Japanese Patent Application Laid-open No. 2007-304405 discloses that a linear velocity difference between an intermediate transfer belt and a photosensitive drum is set in such a manner that the linear velocity difference is set smaller for a photosensitive drum for black disposed at the most downstream position and for a photosensitive drum for color disposed at the most upstream position, and set larger for photosensitive drums for other colors arranged between the most upstream position and the most downstream position.

Japanese Patent Application Laid-open No. 2003-57916 aims to prevent the transfer hollow caused by agglomeration of toner on the photosensitive element as a result of the toner on the photosensitive element being compressed in a primary transfer nip. It has been found that this method, however, is not an effective solution for preventing the transfer hollow because this method may promote the occurrence of the transfer hollow because of the toner having poor fluidity due to the added lubricating component.

The transfer hollow is the direct result of the agglomeration of toner, which is what is called a "packing", caused by a pressure applied to a toner layer on the photosensitive drum in the transferring operation. The toner layer before being transferred forms a layered structure having appropriate gaps between toner particles. The soft layer is pressed by a force applied thereto when pressure is applied in the transfer operation. In the pressing, an edge portion of the toner layer crumbles to surrounding areas including no toner layer to distribute the pressure while a central portion of the toner layer is pressed and agglutinated (packed) because the central portion hardly moves to surrounding areas and cannot distribute the applied pressure.

The toner thus packed increases sticking force to the surface of the photosensitive drum and cannot be readily moved (transferred) to the intermediate transfer belt even though a predetermined transfer electric field is applied. As a result, the "transfer hollow" occurs. The toner having poor fluidity due to the added lubricating component readily causes the "transfer hollow" particularly because the toner is readily agglutinated.

When the linear velocity of the intermediate transfer belt is set faster than the photosensitive drum as the method for preventing the transfer hollow as disclosed in Japanese Patent Application Laid-open No. 2003-57916, the toner on the photosensitive drum receives a shearing force in the moving direction of the intermediate transfer belt when passing through the primary transfer nip, the number of toner particles per unit area is reduced when the toner is transferred from the drum to the belt, and thus the toner thickness is effectively reduced in the nip portion. As a result, generally, the packing hardly occurs.

However, it has been found that primary transfer efficiency and graininess of dots deteriorate when excess liner velocity difference is set between the photosensitive drum and the intermediate transfer belt, on the base of the results of experiments performed by the applicant. That is, the prevention of the transfer hollow and the increase in primary transfer efficiency or improvement of graininess of dots are in the relation of trade-off.

There is a need to enable the occurrence of the transfer hollow to be reliably prevented for long period of time even when the toner is used that has low fluidity and high adhering force between toner particles due to the added lubricating component, and to achieve both of the prevention of transfer hollow and the downsizing, the longer operating life, and the cost reduction of the image forming apparatus in a good balanced manner.

SUMMARY OF THE INVENTION

It is an object of the present invention to at least partially solve the problems in the conventional technology.

According to an embodiment, provided is a color image forming apparatus that includes: a plurality of image carriers that form a toner image of black and toner images of a plurality of colors excluding black by electrophotography based on image information, and carry the toner images; an intermediate transfer body that makes contact with the image carriers; and a primary transfer unit that transfers the toner images on the image carriers to the intermediate transfer body. A line velocity difference is set between the image carriers and the intermediate transfer body; an accelerated cohesion degree of toner is equal to or larger than 54%; a linear velocity difference $X_1$ between the image carrier for black and the intermediate transfer body satisfies a relation of $0<X_1\leq 1.2$ mm/sec within which the linear velocity of the image carrier for black is smaller than the linear velocity of the intermediate transfer body; and a linear velocity difference $X_2$ between the image carriers for the colors except the black and the intermediate transfer body satisfies a relation of $2.1\leq X_2\leq 4.0$ mm/sec within which the linear velocities of the image carriers for the colors are smaller than the linear velocity of the intermediate transfer body.

The reason why the linear velocity difference $X_1$ is set to such a relatively small range is that the transfer hollow of black hardly occurs because black is basically used for a single color image and the amount of toner forming the image is small, but black is frequently used for forming images and thus the transfer hollow and the deterioration of the graininess are readily noticed. Accordingly, the linear velocity difference between the image carrier for black and the intermediate transfer body is smaller so as to be in a relatively small range of $0<X_1\leq 1.2$ mm/sec.

In contrast, the linear velocity difference $X_2$ between the image carriers for color other than black and the intermediate transfer body is smaller so as to be in a relatively large range of $2.1\leq X_2\leq 4.0$ mm/sec. In this way, a range in which the linear velocity of the image carrier is slower than that of the intermediate transfer body is set smaller for black and is set larger for color to distinct both of the linear velocities.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a table illustrating comparison results obtained through controlling the linear velocity of the photosensitive drum in accordance with a plurality of patterns; and FIG. 8 is a cross-sectional view of the intermediate transfer belt.

DETAILED DESCRIPTION OF THE PREFERRED EMBODIMENTS

The embodiments are described below with reference to the accompanying drawings. In the accompanying drawings, members and elements having the same functions or shapes are labeled with the same numerals and the duplicated descriptions thereof are omitted.

Image Forming Apparatus

Figure 1:
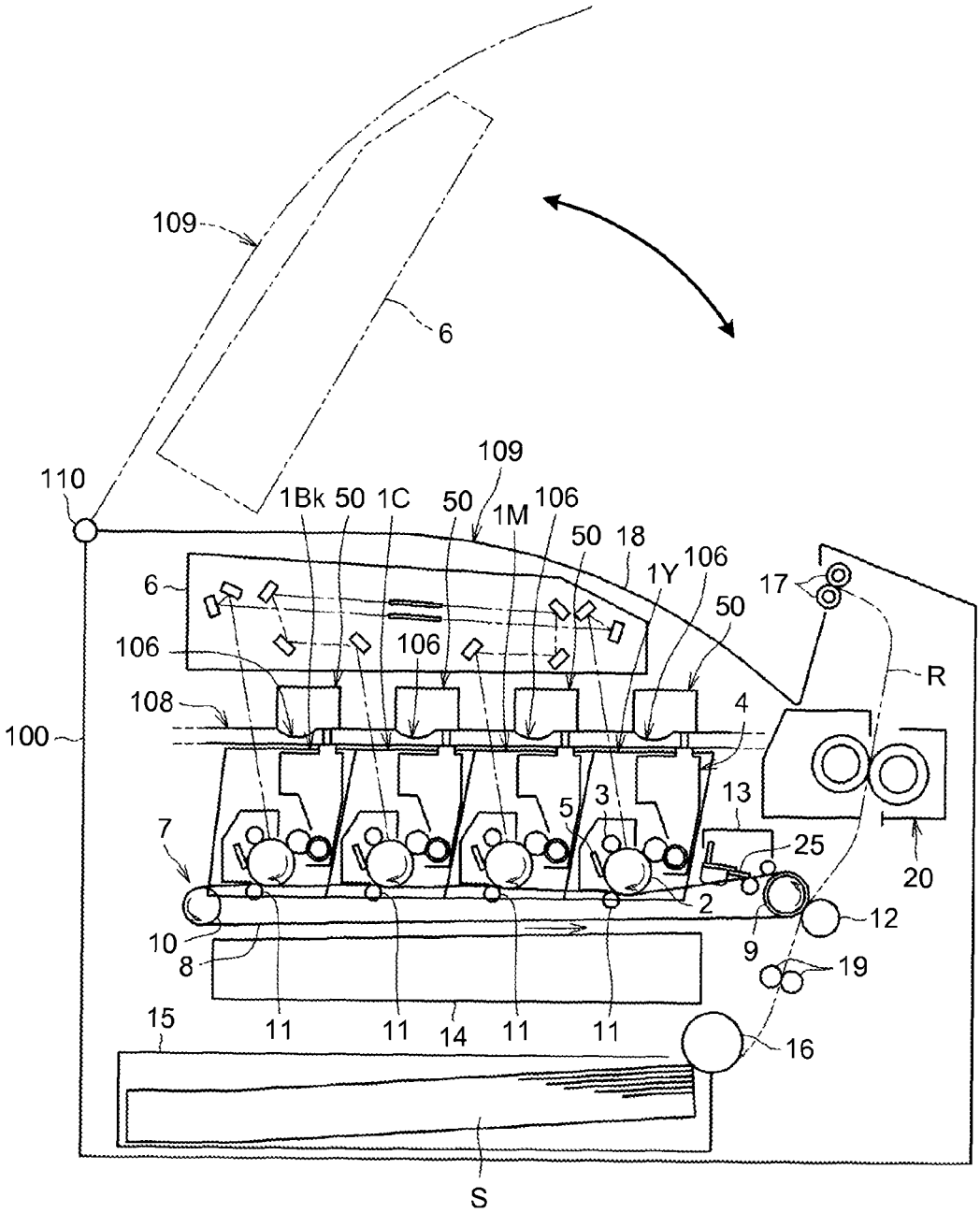
FIG. 1 is a schematic cross-sectional view of an image forming apparatus according to embodiments.

An overall structure and operation of an image forming apparatus is applied are described with reference to FIG. 1. The image forming apparatus illustrated in FIG. 1 is a color laser printer including a main body (main body of the image forming apparatus) 100. Four process units 1Y, 1M, 1C, and 1Bk serving as image forming units are attached to the main body 100 in a detachable manner. The process units 1Y, 1M, 1C, and 1Bk have the same structure except for that they have developers of respective colors of yellow (Y), magenta (M), cyan (C), and black (Bk), which correspond to color components of a color image.

Specifically, each of the process units 1Y, 1M, 1C, and 1Bk includes a photosensitive drum 2 having a cylindrical shape and serving as a latent image carrier, a charging device having a roller charging device 3 that makes contact with and is driven to rotate by the photosensitive drum 2 to charge a surface of a photosensitive element, for example, a developing device 4 (one-component contact developing unit) that supplies the developer to a latent image on the photosensitive drum 2, and a cleaning device that has a cleaning blade 5 for cleaning the surface of the photosensitive drum 2; and a conveyor screw 60, for example.

For example, the photosensitive drum 2 has a diameter of 30 mm and rotates at a circumferential speed of 50 mm/sec to 200 mm/sec. The photosensitive drum 2 is uniformly charged, for example, at a surface potential of −500 V by a direct-current (DC) bias or a bias in which an alternating-current (AC) is superimposed on a DC bias applied by a high-voltage power supply (not illustrated). The photosensitive drum 2 visualizes a static latent image on the photosensitive drum 2 as a toner image by a predetermined developing bias, such as −200 V, supplied from the high-voltage power supply (not illustrated). The developing device 4 contains one-component toner (one-component developer) having a charge polarity of negative. The toner is described later. A two-component developer composed of toner and carrier may be used as the developer.

Generally, a lubricant applying device is disposed in the vicinity of the photosensitive drum 2 and the lubricant applying device applies lubricant on the outer circumferential surface of the photosensitive drum 2 for prevention of abrasion. The lubricant is effective for prevention of transfer hollow, but, hinders downsizing of the photosensitive drum 2 and the peripheral structure of the photosensitive drum 2, and makes it difficult to downsize the image forming apparatus. Accordingly, embodiments eliminate the lubricant applying device to achieve the downsizing and cost reduction of the image forming apparatus.

In addition, lubricating effect on the photosensitive drum 2 is maintained using toner to which silica particles having surfaces treated with silicone oil are externally added, thereby making it possible to suppress a surface abrasion of the photosensitive drum 2, extend the operating lives and reduce the running costs of the process units.

When such toner containing the external additive having lubricating effect is used, the cohesion degree of toner is increased, and the transfer hollow property and graininess property are adversely affected if the velocity of the photosensitive drum 2 is controlled in a conventional manner. In contrast, in the embodiments, the photosensitive drum 2 is driven while a linear velocity difference is set between the photosensitive drum 2 and an intermediate transfer belt 8, resulting in the linear velocity difference causing shearing effect to occur in a primary transfer nip. The toner having a high cohesion degree increases its sticking force on the outer circumferential surface of the photosensitive drum 2 and is prone to adhere to the outer circumferential surface of the photosensitive drum 2, but the portion being prone to adhere, is crumbled by the shearing effect, resulting in the toner being smoothly transferred to the intermediate transfer belt 8 and the transfer hollow being effectively prevented.

In contrast, when the linear velocity of the photosensitive drum 2 is faster than that of the intermediate transfer belt 8, the thickness of a toner layer around the primary transfer nip is increased, thereby promoting the occurrence of packing. As a result, the transfer hollow property and the graininess property are hardly improved.

The photosensitive drums 2 can be individually driven by respective independent motors. Alternatively, a photosensitive drum 2Bk for black may be driven by a dedicated motor and the other three photosensitive drums 2 for color may be driven by a common motor. The driving of the three photosensitive drums 2 for color by a single motor enables the number of parts and costs to be reduced. As a result, with respect to black that the linear velocity of the photosensitive drum 2Bk for black, which is readily sensed visually, can be exclusively controlled as later described, and the photosensitive drum 2Bk can be controlled with higher priority to the graininess of black.

The photosensitive drum 2 is exposed by an exposing unit serving as a latent image forming unit. As a result, a static latent image of image information is formed on the outer circumferential surface of the photosensitive drum 2. This exposing process is performed by a laser beam scanner using a laser diode or a light-emitting diode (LED), for example. The surface potential of the exposed areas of the photosensitive drum 2 lowers to around −50 V after the exposing process, for example.

In FIG. 1, the photosensitive drum 2, the roller charging device 3, the developing device 4, and the cleaning blade 5 included in the process unit 1Y for yellow are illustrated with numerals while the numerals of those in the process units 1M, 1C, and 1Bk are omitted.

Toner cartridges 50, which serve as developer containers containing toner to be supplied to the respective developing devices 4, are disposed above the four developing devices 4 included in the respective process units 1Y, 1M, 1C, and 1Bk. In the embodiments, a separating plate 108 provided to the main body 100 is disposed between the toner cartridges 50 and the developing devices 4. The separating plate 108 has four attaching portions 106, to which the respective toner cartridges 50 are attached in a detachable manner.

An exposing device 6 that exposes the surfaces of the photosensitive drums 2 of the process units 1Y, 1M, 1C, and 1Bk is disposed nearly above the toner cartridges 50. The exposing device 6 includes a light source, a polygon mirror, an f-θ lens, and a reflection mirror, and irradiates the surfaces of the respective photosensitive drums 2 with laser light on the basis of image data.

A top cover 109 is disposed at the top portion of the main body 100 in such a manner that the top cover 109 can be opened or closed in the up-down direction by being rotated around a fulcrum 110. The exposing device 6 is attached to the top cover 109. This structure enables, when the top cover 109 is opened, the exposing device 6 to be evacuated from a space nearly above the toner cartridges 50 and any of the toner cartridges 50 to be attached to or detached from the main body 100 through an upper opening of the main body 100.

A transfer device 7 is disposed below the process units 1Y, 1M, 1C, and 1Bk. The transfer device 7 has the intermediate transfer belt 8, which is an endless belt and serves as a transfer body. The intermediate transfer belt 8, which is winded between a driving roller 9 and a driven roller 10, moves circularly (rotates) in the arrow direction in FIG. 1 by the rotation of the driving roller 9 in a counterclockwise direction in FIG. 1.

The arrangement of the process units 1Y, 1M, 1C, and 1Bk disposed above the intermediate transfer belt 8 enables a user to readily perform replacement of the process units 1Y, 1M, 1C, and 1Bk. In the developing device 4 disposed in such a vertical arrangement, a partial pressure of toner inside a developing housing 40 is high between a developing roller 41 and a supplying roller 42, for example, thereby causing the toner to be damaged. When the toner is damaged, fluidity of the toner further deteriorates due to peeling of the external additive and in addition cohesive force increases, thereby promoting the occurrence of the transfer hollow. For employing the vertical arrangement of the developing device 4, it is necessary to take action on the transfer hollow. In the embodiment, the linear velocity difference is set as the action for prevention of the transfer hollow.

Examples of the roller that can be used as the driving roller 9 include a polyurethane rubber (having a coating thickness of 0.3 mm to 1 mm) and a thin layer coating roller (having a coating thickness of 0.03 mm to 0.1 mm). In the embodiments, a urethane coating roller (having a coating thickness of 0.05 mm and a roller diameter of 19 mm) is used that has a small diameter change due to temperature change. An electrical resistance value of the roller is set to a value of equal to or smaller than $10^6\Omega$ such that the resistance value is lower than that of a secondary transfer roller 12.

The intermediate transfer belt 8 is made of a material composed of a resin material, such as polyvinylidene difluoride (PVDF), ethylene tetrafluoroethylene (ETFE) copolymer, polyimide (PI), polycarbonate (PC), and thermoplastic elastomer (TPE), in which a conductive material such as carbon black is dispersed. The intermediate transfer belt 8 is made as an endless belt using the material formed in a resin film. In the embodiments, a single layer of TPE having an extension elastic modulus of 1000 to 2000 MPa to which carbon black is added is used as the intermediate transfer belt 8 with a thickness of 90 to 160 μm and a width of 230 mm.

The material used in the embodiment has a volume resistivity of $10^8$ Ω·cm to $10^{11}$ Ω·cm and a surface resistivity of $10^8$ Ω/square to $10^{11}$ Ω/square under conditions of 23° C. and 50% RH (both resistivities are measured using Hiresta-UP MCP-HT450, which is manufactured by Mitsubishi Chemical Corporation, under the conditions of an applied voltage of 500 V and an applied time of 10 seconds).

Four primary transfer rollers 11 serve as primary transfer units included in a direct applying scheme and are disposed at positions facing the four photosensitive drums 2 with the intermediate transfer belt 8 interposed therebetween. Each primary transfer roller 11 is a sponge roller having a diameter of 12 mm to 16 mm, and transfers the toner image on the photosensitive drum 2 to the intermediate transfer belt 8 upon receiving a predetermined primary transfer bias of +100 V to +2000 V applied by an independent high-voltage power supply (not illustrated). The primary transfer rollers 11 push the inner circumferential surface of the intermediate transfer belt 8 at the respective arranged positions. At each portion at which the pushed portion of the intermediate transfer belt 8 and the photosensitive drum 2 make contact with each other, a primary transfer nip is formed.

A preferable range of a pushing pressure of the primary transfer roller 11 to the intermediate transfer belt 8 is from 13 to 20 N/m for good primary transfer. The structure in which the intermediate transfer belt 8 is supported by the two axes of the driving roller 9 and the driven roller 10 is simple. The structure conserves a space and also is advantageous for cost reduction. The structure, however, has a problem in that the intermediate transfer belt 8 gets deformed because of the large curvature of the rollers 9 and 10 influencing the intermediate transfer belt 8. Once the belt is deformed, a gap appears between the primary transfer roller 11 and the intermediate transfer belt 8 at the contact portion of the photosensitive drum 2 and the intermediate transfer belt 8, resulting in the occurrence of a primary transfer defect. The primary transfer defect is prevented by setting the primary transfer pressure to the above-described range. However, if higher pressure is applied in order to stabilize the primary transfer pressure, the transfer hollow is increased. Thus, the linear velocity differences $X_1$ and $X_2$ are provided as described above to reduce the transfer hollow property.

Examples of the roller used as the primary transfer roller 11 include an ion conductive roller (urethane with dispersed carbon, nitrile butadiene rubber (NBR), or epichlorohydrin rubber) and an electronically conductive roller (ethylene propylene diene monomer (EPDM)) having a resistance value adjusted in a range from $10^6$ to $10^8\Omega$.

Because the ion conductive roller and the electronically conductive roller are expensive, a metallic roller whose cost is low may be used as the primary transfer roller, and an indirect applying scheme may be employed in which the primary transfer roller 11 is disposed off the center of the photosensitive drum 2 and the primary transfer nip is formed between the intermediate transfer belt 8 and the photosensitive drum 2. The indirect applying scheme is more effective as a counter measure for preventing the transfer hollow because the scheme can distribute the primary transfer pressure.

The secondary transfer roller 12 serving as a secondary transfer unit is disposed at a position facing the driving roller 9. The secondary transfer roller 12 pushes the outer circumferential surface of the intermediate transfer belt 8. A secondary transfer nip is formed at a position at which the secondary transfer roller 12 and the intermediate transfer belt 8 make contact with each other.

As a method of applying a secondary transfer bias, i.e., a method of forming a secondary transfer electric field, there are two methods, which are an attractive force transfer technique and a repulsive force transfer technique. In the attractive force transfer technique, the secondary transfer electric field is formed by applying a positive bias to the secondary transfer roller 12 and by earthing the driving roller 9. In the repulsive force transfer technique, the secondary transfer electric field is formed by applying a negative bias to a driving roller 9 and by earthing the secondary transfer roller 12.

In the embodiments, the attractive force transfer method is employed. A current of +5 to 100 μA is applied to the secondary transfer roller 12 by constant current control as a transfer bias of the secondary transfer nip when sheets pass through the secondary transfer nip.

The secondary transfer roller 12 is a sponge roller having a diameter of 16 to 25 mm. Examples of the roller include an ion conductive roller (urethane with dispersed carbon, NBR, or epichlorohydrin rubber) and an electronically conductive roller (EPDM) having a resistance value adjusted in a range from $10^6\Omega$ to $10^8\Omega$.

When the resistance value of the secondary transfer roller 12 exceeds the range, sufficient currents hardly flow and a higher voltage thus needs to be applied to achieve desired transfer performance, thereby increasing a cost of the power supply. In addition, the applied higher voltage causes discharge to occur in air gaps at the front and rear of the secondary transfer nip. As a result, white spots due to the discharge occur on a half-tone image. This defect markedly occurs under low temperature and low humidity conditions (e.g., a temperature of 10° C. and a relative humidity of 15%).

In contrast, when the resistance value of the secondary transfer roller 12 is lower than the range, the transfer performance differs between a multicolor image area (e.g., in which three colors are overlapped) and a single color image area both of which are present on the same image. Specifically, the single color image area can be transferred without any problem owing to sufficient currents even applied with a relatively low voltage because the area is a relatively thin layer of a single color in the secondary transfer nip, whereas sufficient currents hardly flow in the multicolor image area because the area is a relatively thick layer composed of two layers or three layers of colors in the secondary transfer nip. As a result, the multicolor image area cannot be transferred unless a higher voltage than an optimum voltage of the single color image area is applied to the multicolor image area. Accordingly, when the resistance value of the secondary transfer roller 12 is lower than the range and a higher voltage is set suitable for the multicolor image area, transfer efficiency in the single color image area is reduced because excess transfer currents are applied to the single color image area.

The resistance values of the primary transfer roller 11 and the secondary transfer roller 12 are obtained by the following manner: each of the rollers is set on a metallic plate having conductivity, a voltage of 1 kV is applied between a cored bar of the roller and the metallic plate while a load of 4.9 N is applied to each of the both ends of the cored bar (total 9.8 N) and a current flowing between the cored bar and the metallic plate is measured, and the resistance value is calculated from the current value and the voltage, which is 1 kV.

A belt cleaning device 13 for cleaning the surface of the intermediate transfer belt 8 is disposed on the outer circumferential surface at the right end side in FIG. 1 of the intermediate transfer belt 8. A waste toner conveying hose (not illustrated) extending from the belt cleaning device 13 connects to an inlet of a waste toner container 14 disposed below the transfer device 7.

The belt cleaning device 13, which has a cleaning blade 25 as illustrated in FIG. 1, scrapes toner remaining on the intermediate transfer belt 8 after transfer by contacting the cleaning blade 25 with the intermediate transfer belt 8 in a counter-abutment manner. The belt cleaning device 13 may use a static brush or a static roller instead of the cleaning blade 25.

The static cleaning device may be required to preliminarily charge the remaining toner after transfer in accordance with use conditions of the image forming apparatus because the device uses a cleaning brush or a cleaning roller with an applied bias. This results in an increase in size of the cleaning device, one or two additional high-voltage power supplies being required, or extra operation for bias cleaning being needed.

The static cleaning device has such disadvantages. Hence, it is preferable that the belt cleaning device uses the cleaning blade from the viewpoints of downsizing, cost reduction, and convenience in cleaning of the image forming apparatus.

A paper feeding cassette 15 that houses a recording medium S such as paper or a sheet for an overhead projector (OHP) is disposed at a lower portion of the main body 100. The paper feeding cassette 15 is provided with a paper feeding roller 16 that feeds the recording medium S housed in the paper feeding cassette 15 outside the paper feeding cassette 15. A pair of discharging rollers 17 that discharge the recording medium S outside the main body 100 are disposed at an upper portion of the main body 100. A discharge tray 18 that stocks the recording media S discharged by the discharging rollers 17 is provided at the top cover 109.

A conveying route R is provided inside the main body 100 to convey the recording medium S from the paper feeding cassette 15 to the discharge tray 18 through the secondary transfer nip. In the conveying route R, a pair of timing rollers 19 is disposed upstream from the secondary transfer roller 12 in a recording medium conveying direction. The timing rollers 19 serve as a conveying unit that conveys the recording medium S to the secondary transfer nip by controlling conveying timing. The timing rollers 19 stop a transfer sheet for timing adjustment such that the front edge of the sheet and the front edge of an image coincide with each other. The timing rollers 19 have functions such as of correcting oblique feeding taking place in paper feeding by forming a loop at the front edge of a sheet and of adjusting a margin width at the front edge of a sheet by controlling registration, in addition to the function of the timing adjustment. A fixing device 20 is disposed downstream from the secondary transfer roller 12 in the recording medium conveying direction.

Operation of Image Forming Apparatus

The image forming apparatus operates as follows. The recording medium S is set in the paper feeding cassette 15 or to a bypass paper feeding port (not illustrated) and fed by the paper feeding roller 16, the timing rollers 19, and the like in synchronization with timing at which the front edge of a toner image on the surface of the intermediate transfer belt 8 reaches the secondary transfer nip. Then, the toner image on the intermediate transfer belt 8 is transferred onto the recording medium S by applying a predetermined secondary transfer bias from the high-voltage power supply (not illustrated). In the embodiments, the recording medium S is fed along a vertical path. The recording medium S is separated from the intermediate transfer belt 8 due to the curvature of the driving roller 9 making contact with the secondary transfer roller 12 with a pressure. The toner image transferred on the recording medium S is fixed by the fixing device 20. Thereafter, the recording medium S passes through the discharging rollers 17 and is discharged to the discharge tray 18.

Once image forming operation starts, the photosensitive drums 2 of the respective process units 1Y, 1M, 1C, and 1Bk are driven to rotate clockwise in FIG. 1, and the surfaces of the respective photosensitive drums 2 are uniformly charged in a predetermined polarity by the respective roller charging devices 3. The charged surfaces of the respective photosensitive drums 2 are irradiated with laser light emitted from the exposing device 6 on the basis of image information of a document scanned by an image scanning device (not illustrated). As a result, static latent images are formed on the surfaces of the respective photosensitive drums 2.

The image information exposed on each photosensitive drum 2 is the image information of a corresponding single color of four component colors of yellow, magenta, cyan, and black into which a desired full color image is decomposed. The static latent images formed on the respective photosensitive drums 2 are visualized as respective toner images with toner of the respective corresponding colors supplied by the respective developing devices 4.

Subsequently, the driving roller 9, on which the intermediate transfer belt 8 is winded, rotates and causes the intermediate transfer belt 8 to run circularly in the arrow direction in FIG. 1. A voltage under a constant voltage control or a constant current control having a polarity opposite the charged polarity of the toner is applied to each primary transfer roller 11, resulting in a transfer electric field being formed in the primary transfer nip between each primary transfer roller 11 and the corresponding photosensitive drum 2. The toner images of the corresponding colors on the respective photosensitive drums 2 are sequentially transferred and overlapped on the intermediate transfer belt 8 by the transfer electric fields formed in the respective primary transfer nips.

As a result, a full color toner image is carried on the surface of the intermediate transfer belt 8. The toner remaining on the respective photosensitive drums 2 after the transfer to the intermediate transfer belt 8 is removed by the respective cleaning blades 5.

The recording medium S housed in the paper feeding cassette 15 is fed to the conveying route R by the rotation of the paper feeding roller 16. The recording medium S fed to the conveying route R is conveyed to the secondary transfer nip between the secondary transfer roller 12 and the intermediate transfer belt 8 by the timing rollers 19 by adjusting timing. A transfer voltage having a polarity opposite the toner charged polarity of the toner image on the intermediate transfer belt 8 is applied to the secondary transfer roller 12, thereby forming a transfer electric field in the secondary transfer nip.

The toner image on the intermediate transfer belt 8 is transferred onto the recording medium S at once by the transfer electric field formed in the secondary transfer nip. The toner remaining on the intermediate transfer belt 8 after the transfer is removed by the belt cleaning device 13 and the removed toner is conveyed to and collected in the waste toner container 14.

Thereafter, the recording medium S on which the toner image is transferred is conveyed to the fixing device 20, in which the toner image on the recording medium S is fixed to the recording medium S. Then, the recording medium S is discharged outside the apparatus by the discharging rollers 17 and stocked on the discharge tray 18.

An image forming processing speed is changed depending on a type of the recording medium S. Specifically, when the recording medium S having a basis weight of 100 g/m$^2$ is used, the image forming processing speed is reduced to half its typical value. The recording medium S passes through a fixing nip formed by the fixing roller pair taking twice as long as the typical image forming processing speed, thereby enabling the toner image to be reliably fixed.

The above description is based on the image forming operation of forming a full color image on the recording medium. A single color image can be formed using any one of the process units 1Y, 1M, 1C, and 1Bk. A two-color image or a three-color image can be formed using two or three process units.

Developing Device

Figure 2:
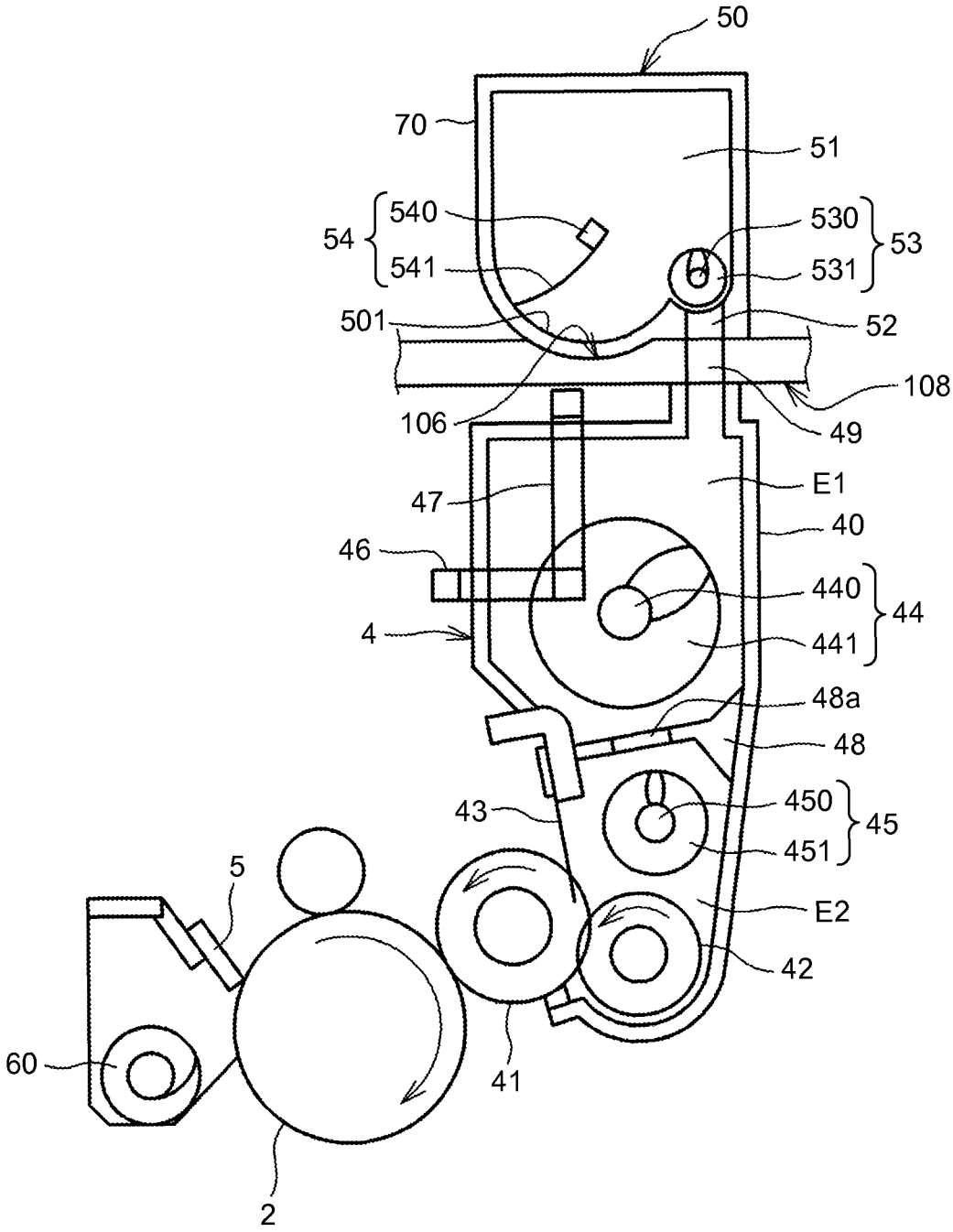
FIG. 2 is a schematic cross-sectional view of a developing device used in the image forming apparatus in the embodiments.

FIG. 2 is a schematic cross-sectional view of the toner cartridge and the developing device. As illustrated in FIG. 2, the developing device 4 includes the developing housing 40 that contains toner, the developing roller 41 that serves as a developer carrier carrying the toner, the supplying roller 42 that serves as a developer supplying member supplying the toner to the developing roller 41, a developing blade 43 that serves as a regulating member regulating the amount of toner carried on the developing roller 41, two conveying screws 44 and 45 that serve as conveying members conveying the toner, and two light guiding members 46 and 47.

A partition member 48 having communication holes 48*a* divides the inside of the developing housing 40 into a first region E1 on the upper side and a second region E2 on the lower side in FIG. 2. The communication holes 48*a* are provided on both ends of the partition member 48 (on the near side and the far side in the direction orthogonal to FIG. 2) one each. Accordingly, the first region E1 and the second region E2 communicate with each other through the portion to which the two communication holes 48*a* are provided.

In the first region E1, the conveying screw 44 and the light guiding members 46 and 47 are provided. In the second region E2, the conveying screw 45 and the supplying roller 42 are provided. At an opening, which faces the photosensitive drum 2, of the second region E2, the developing roller 41 and the developing blade 43 are provided.

The conveying screws 44 and 45 have spiral-shaped wings 441 and 451 provided on the outer peripheries of rotary shafts 440 and 450, respectively. Upon rotating, the conveying screws 44 and 45 convey toner in respective axial directions. In the embodiments, the conveying screws 44 and 45 convey toner in opposite directions.

The developing roller 41 is composed of a metallic cored bar and conductive rubber provided on the outer periphery of the cored bar. In the embodiments, the cored bar has an outer diameter of 6 mm, the conductive rubber has an outer diameter of 12 mm and a hardness of Hs of 75 degrees (Hs: spring hardness specified in Japan industrial standards). The conductive rubber is adjusted to have a resistance value ranging from approximately $10^5\Omega$ to $10^7\Omega$. Examples of the conductive rubber include conductive urethane rubber and silicone rubber. The developing roller 41, which rotates in a counterclockwise direction in FIG. 2, conveys the developer carried on the surface thereof to the developing blade 43 and to the position facing the photosensitive drum 2.

Generally, a sponge roller is used as the supplying roller 42, for example. A sponge roller composed of a metallic cored bar and polyurethane foam that has semi-conductivity with carbon mixed therein and is stuck to the outer periphery of a metallic cored bar is appropriate. The supplying roller 42 abuts the developing roller 41. The nip formed by the supplying roller 42 and the developing roller 41 after being abutted is typically ranging from approximately 1 mm to 3 mm.

In the embodiment, the size of the nip is 2 mm. The supplying roller 42 rotates in a direction opposite the rotational direction of the developing roller 41 (*a* counter direction, i.e., in the counterclockwise direction in FIG. 2), thereby enabling the toner in the developing housing 40 to be efficiently supplied to the surface of the developing roller 41.

The developing blade 43 regulates the amount of toner on the developing roller 41 and charges the toner by contacting the toner with the developing roller 41 with friction. The developing blade 43 is a stainless steel (SUS) plate having a thickness of approximately 0.1 mm, for example. The developing blade 43 abuts the surface of the developing roller 41 on the tip side of the developing blade 43. The control of the amount of toner on the developing roller 41 by the developing blade 43 is a very important parameter for stabilizing developing performance and achieving good image quality. The relevant parameters of the developing blade 43 for general products are precisely controlled as follows. An abutting pressure of the developing blade 43 to the developing roller 41 is controlled in a range from approximately 20 N/m to 60 N/m. The position of the nip from the tip of the developing blade 43 is controlled in a range of approximately 0.5±0.5 mm.

Those parameters are properly determined in accordance with characteristics of, for example, the toner, the developing roller, and the supplying roller to be used. In the embodiments, a stable thin layer of toner can be formed on the developing roller 41 by setting the relevant parameters as follows: the developing blade 43 is a stainless steel plate having a thickness of 0.1 mm, the abutting pressure is 45 N/m, the position of the nip is 0.2 mm from the tip of the developing blade 43, and the length (free length) from a supporting edge to a free edge (tip) of the developing blade 43 is 14 mm.

The light guiding members 46 and 47 are made of a material having a good optical transparency. Preferable examples of the material, when resin is used, include an acrylic material and a polycarbonate material both of which have a high degree of transparency. Optical glass that can obtain good optical characteristics can be also used as the light guiding members 46 and 47, for example. Alternatively, optical fibers may be also used as the light guiding members 46 and 47. In this case, flexibility in design of an optical path formed by the light guiding members 46 and 47 is increased.

One end of each of the light guiding members 46 and 47 is exposed outside the developing housing 40. In a state when the process unit is attached to the image forming apparatus body, a light-emitting element and a light receiving element (both elements are not illustrated) that are provided to the main body and serve as toner amount detecting units face the respective exposed edges. In such a state in which the light-emitting element and the light receiving element face the respective exposed edges of the light guiding members 46 and 47, an optical path is formed from the light-emitting element to the light receiving element through the light guiding members 46 and 47.

That is, light emitted from the light-emitting element is guided inside the developing housing 40 through the light guiding member 46 and further guided to the light receiving element though the light guiding member 47. In the developing housing 40, a predetermined gap is provided between the opposing edges of the light guiding members 46 and 47.

The toner cartridge 50 is attached to the attaching portion 106 on the separating plate 108. The attaching portion 106 has a supplying hole 49 connecting to a discharging hole 52 of the toner cartridge 50. The toner cartridge 50 includes a container body 70 that has therein a developer container portion 51 containing toner, the discharging hole 52 that is provided at the lower portion of the developer container portion 51 and discharges the toner outside the toner cartridge 50, a conveying screw 53 that conveys the toner in the developer container portion 51 to the discharging hole 52, and an agitator 54 that serves as an agitating member agitating the developer in the developer container portion 51.

For example, the conveying screw 53 and the agitator 54 included in the toner cartridge 50 can connect to a main body driving unit (not illustrated). The main body driving unit and those components included in the toner cartridge 50 can be controlled to connect to each other or to release the connection by a known method using such as clutches, thereby enabling the components to be readily driven for supplying toner. A toner supplying amount can be controlled by operating time of the conveying screw 53. For example, a supplying amount of toner can be controlled by changing the operating time in accordance with the color of the toner or a fluidity change of the toner caused by temperature and humidity of environment.

The conveying screw 53 has a spiral-shaped wing 531 provided on the outer periphery of a rotary shaft 530. The agitator 54 has a deformable platy wing 541 provided to a rotary shaft 540 disposed in parallel with the rotary shaft 530 of the conveying screw 53. The wing 541 of the agitator 54 is made of a flexible material such as a film of polyethylene terephthalate (PET). As illustrated in FIG. 2, a bottom surface 501 of the developer container portion 51 is formed in an arc-like shape along a rotational orbit of the wing 541, thereby enabling the amount of toner remaining in the developer container portion 51 without being moved by the wing 541 to be reduced.

In the embodiment, the toner cartridge 50 alone is attached to the main body 100 in a detachable manner. The attachment-detachment structure of the toner cartridge 50, however, is not limited to this structure. For example, the toner cartridge 50 may be integrated with the developing device 4 or the photosensitive drum 2 to compose a replaceable process unit. Alternatively, the toner cartridge 50 may be integrated with the developing device 4 to compose a replaceable developing unit. In this case, the toner cartridge 50 can be directly attached to the top of the developing device 4 by eliminating the separating plate 108 and providing the attaching portion 106 that is provided to the separating plate 108 on the top of the developing device 4.

Operation of Developing Device

Developing operation of the developing device is described with reference to FIG. 2. Once an instruction to start image forming operation is output and the developing roller 41 and the supplying roller 42 start rotating, toner is supplied by the supplying roller 42 to the surface of the developing roller 41 and carried on the surface. The toner carried on the developing roller 41 passes through the nip between the developing roller 41 and the developing blade 43. In the nip, the thickness of the toner is regulated to a uniform thickness and at the same time charged by friction.

The toner on the developing roller 41, which is charged by friction, is transferred to a static latent image on the photosensitive drum 2 facing the developing roller 41 at an amount corresponding to the surface potential of the photosensitive drum 2. As a result, a toner image corresponding to the static latent image is formed on the photosensitive drum 2. The toner transferred on the surface of the photosensitive drum 2 is primarily transferred to the intermediate transfer belt 8. The toner remaining on the photosensitive drum 2 without being primarily transferred to the intermediate transfer belt 8 is removed by the cleaning blade 5, and thereafter is collected in the waste toner container 14 in the image forming apparatus main body 100.

Toner Supplying Operation

Operation of supplying toner to the developing device 4 is described below. Toner is supplied to the developing device 4 by either a technique in which the toner is supplied when the amount of toner in the developing housing 40 is equal to or smaller than a predetermined reference value or another technique in which the toner is supplied each time when the number of rotations or a running distance of the photosensitive drum 2 reaches a fixed number or distance.

In the former supplying method, the light guiding members 46 and 47 are used for detecting the amount of toner. When the amount of toner in the developing housing 40 is larger than the predetermined reference value, toner is present between the opposing edges of the light guiding members 46 and 47. As a result, the toner blocks the optical path between the opposing edges and no light reaches the light receiving element of the main body 100. When the amount of toner in the developing housing 40 is equal to or smaller than the predetermined reference value after the toner is consumed, no toner is present between the opposing edges of the light guiding members 46 and 47. As a result, light travels between the opposing edges. The light receiving element of the main body detects light passing through between the opposing edges and an instruction to supply toner is output.

Figure 6:
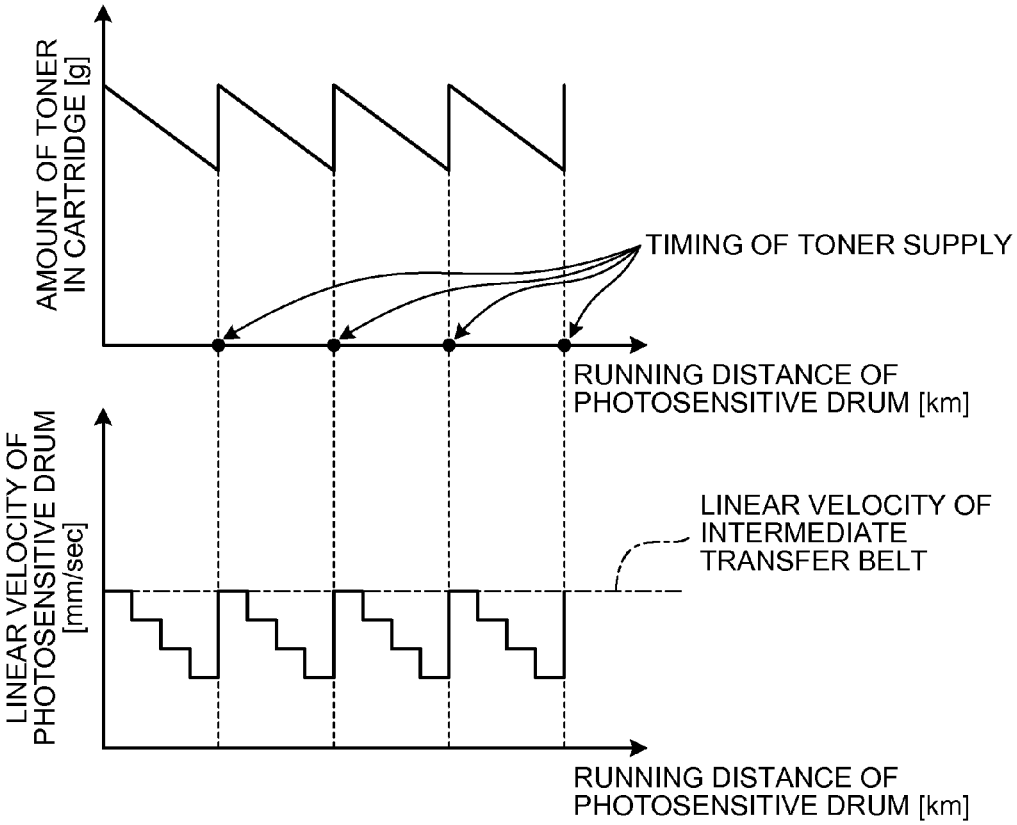
FIG. 6 is a graph illustrating a relation between the amount of toner in a cartridge and linear velocity control of a photosensitive drum.

In the latter supplying technique, as illustrated in FIG. 6, the instruction to supply toner is output each time when the running distance (km) of the photosensitive drum 2 reaches a fixed distance, and toner is supplied inside the developing housing 40 from the toner cartridge 50. In the embodiments, as described later with reference to FIG. 6, the latter supplying technique is employed. However, the former supplying technique can be also employed because the running distance of the photosensitive drum is approximately proportional to a consumption amount of toner.

In the employed supplying technique, a linear velocity (circumferential speed) of the photosensitive drum 2 is reduced by B mm/sec from the same linear velocity as the intermediate transfer belt 8 for each running distance of A km in the running distance of the photosensitive drum 2 starting from the time of toner supply in accordance with the following calculation equation: $B=A\times0.5$ where $0\leq|B|\leq4.0$. That is, the upper limit is 4.0. For example, when the linear velocity of the driven photosensitive drum 2 is changed for each running distance of 1 km of the running distance of the driven photosensitive drum 2, the linear velocity is reduced by 0.5 mm/sec.

It is conceivable that the running distance of the photosensitive drum 2 is approximately proportional to the progress of deterioration of toner. Therefore, in this technique, even though the cohesiveness of the toner further increases because the deterioration of the toner is progressed, the linear velocity of the photosensitive drum 2 is reduced in accordance with the running distance. As a result, the reduction of the linear velocity of the photosensitive drum 2 increases the shearing force in the primary transfer nip between the photosensitive drum 2 and the intermediate transfer belt 8 and promotes the transfer effect from the photosensitive drum 2 to the intermediate transfer belt 8. Consequently, it is possible to prevent the deterioration of the transfer hollow property and the graininess property even though the toner deteriorates.

In addition, the linear velocity of the photosensitive drum 2 is returned to that of the intermediate transfer belt 8 in synchronization with timing of the toner supply. As a result, the graininess can be adjusted to optimum property because characteristics and conditions of the toner in the developing device 4 are improved by the supplied toner.

Once the instruction to supply toner is output, the conveying screw 53 rotates in the toner cartridge 50. The conveying screw 53 conveys toner toward the discharging hole 52 and thereafter the toner is supplied in the first region E1 of the developing housing 40 through the discharging hole 52. In the embodiment, at the same time as the conveying screw 53 rotates in the toner cartridge 50, the agitator 54 also starts rotating. The rotation of the agitator 54 causes toner in the toner cartridge 50 to be agitated and moved toward the conveying screw 53. When the amount of toner in the developing housing 40 is larger than the predetermined reference value as a result of the toner supply (when the toner blocks the optical path between the light guiding members 46 and 47), the conveying screw 53 and the agitator 54 stop the rotation thereof and the toner supply ends.

On the other hand, in the developing housing 40, when toner is supplied, the conveying screw 44 provided in the first region E1 and the conveying screw 45 provided in the second region E2 rotate, and toner is conveyed in opposite directions in the regions E1 and E2. Toner conveyed by the conveying screw 44 to a downstream end in the conveying direction in the first region E1 and toner conveyed by the conveying screw 45 to a downstream end in the conveying direction in the second region E2 pass through the respective communication holes 48*a* provided on both ends of the partition member 48, and the toner from the region E1 is sent into the region E2 while the toner from the region E2 is sent into the region E1.

The toner sent into the region E1 is conveyed by the conveying screw 44 and returned to the region E2 after passing through the communication hole 48*a* provided on the side opposite the communication hole 48*a* through which the toner is sent into the region E1. The toner sent into the region E2 is conveyed by the conveying screw 45 and returned to the region E1 after passing through the communication hole 48*a* provided on the side opposite the communication hole 48*a* through which the toner is sent into the region E2. The operation is repeated, so that supplied new toner and existing toner in the developing housing 40 mix with each other by being circulated between the first region E1 and the second region E2.

In this way, in the embodiment, a condition of toner (ratio of new toner in the whole toner) is uniformed by circulating toner in the developing housing 40, thereby preventing the occurrence of failures such as color unevenness and background smear.

Manufacturing Method of Toner

A manufacturing method of toner used in the image forming apparatus according to the embodiments is described below.

Synthesis of Polyester 1

Into a reaction container provided with a condenser tube, a stirrer, and a nitrogen-introducing tube, 235 parts of ethylene oxide 2 mol adduct of bisphenol-A, 525 parts of propylene oxide 3 mol adduct of bisphenol-A, 205 parts of terephthalic acid, 47 parts of adipic acid, and 2 parts of dibutyl tin oxide were input. Subsequently, the ingredients were reacted together for 8 hours at 230° C. at normal pressure, then further reacted for 5 hours at a reduced pressure of 10 mm Hg to 15 mm Hg. Thereafter, 46 parts of trimellitic anhydride was put into the reaction container and the ingredients were reacted for 2 hours at 180° C. at normal pressure. As a result, polyester 1 was obtained. The obtained polyester 1 had a number average molecular weight of 2600, a weight average molecular weight of 6900, a glass-transition temperature (Tg) of 44° C., and an acid number of 26.

Synthesis of Prepolymer 1

Into a reaction container provided with a condenser tube, a stirrer, and a nitrogen-introducing tube, 682 parts of ethylene oxide 2 mol adduct of bisphenol-A, 81 parts of propylene oxide 2 mol adduct of bisphenol-A, 283 parts of terephthalic acid, 22 parts of trimellitic anhydride and 2 parts of dibutyl tin oxide were input. Subsequently, the ingredients were reacted together for 8 hours at 230° C. at normal pressure, then further reacted together for 5 hours at a reduced pressure of 10 mm Hg to 15 mm Hg. As a result, intermediate polyester 1 was obtained. The obtained intermediate polyester 1 had a number average molecular weight of 2100, a weight average molecular weight of 9500, a Tg of 55° C., an acid number of 0.5, and a hydroxyl value of 49.

Then, 411 parts of the intermediate polyester 1, 89 parts of isophorone diisocyanate, and 500 parts of ethyl acetate were input into a reaction container provided with a condenser tube, a stirrer, and a nitrogen-introducing tube; and the ingredients were reacted together for 5 hours at 100° C. As a result, prepolymer 1 was obtained. The obtained prepolymer 1 has free isocyanate content of 1.53% by weight.

Preparation of Master Batch 1

By a Henschel mixer, 40 parts of carbon black (Regal 400R manufactured by Cabot Corporation), 60 parts of a polyester resin (RS-801, which is manufactured by Sanyo Chemical Industries, Ltd. having an acid number of 10, a molecular weight (Mw) of 20000, and a Tg of 64° C.) as a binder resin, and 30 parts of water were mixed and a mixture in which water had soaked into a pigment agglomerate was obtained. The mixture was kneaded for 45 minutes using a double roll mill with a roll surface temperature being set at 130° C., and thereafter the kneaded mixture was pulverized so as to have a size of 1 mm using a pulverizer. As a result, a master batch 1 was obtained.

Preparation of Pigment and Wax Dispersion Liquid 1 (Oil Phase)

A container provided with a stirring rod and a thermometer was charged with 545 parts of the polyester 1, 181 parts of paraffin wax, and 1450 parts of ethyl acetate. The temperature of the mixture was increased to 80° C. while the ingredients were being stirred, and the temperature of the mixture was kept at 80° C. for 5 hours. Thereafter, the mixture was cooled to 30° C. in 1 hour. Subsequently, a container was charged with 500 parts of the master batch 1, 100 parts of a charge controlling agent 1, and 100 parts of ethyl acetate, and they were mixed for 1 hour. As a result, a raw material solution 1 was obtained.

Subsequently, 1500 parts of the raw material solution 1 was transferred to a container. Then, wax and carbon black were dispersed using a bead mill (Ultra Visco Mill manufactured by Imex Co., Ltd.) under the following conditions: the liquid feeding speed was 1 kg/hr, the disc circumferential speed was 6 m/sec, zirconia beads of 0.5 mm were supplied so as to occupy 80% by volume, and the ingredients were passed three times. Thereafter, 425 parts of the polyester 1 and 230 parts of the raw material solution 1 were added, and the mixture was passed once using the bead mill under the above conditions. As a result, the pigment and wax dispersion liquid 1 was obtained. Then, the pigment and wax dispersion liquid 1 was adjusted to have a solids concentration of 50% (at 130° C. for 30 minutes).

Preparation of Aqueous Phase

In a container, 970 parts of ion-exchanged water, 40 parts of a 25% aqueous dispersion liquid of organic resin fine particles (a copolymer of styrene-methacrylic acid-butyl acrylate-sodium salt of methacrylic acid ethylene oxide adduct sulfate ester) for dispersion stability, 140 parts of a 48.5% aqueous solution of sodium dodecyl diphenyl ether disulfonic acid (Eleminol MON-7 manufactured by Sanyo Chemical Industries, Ltd.), and 90 parts of ethyl acetate were mixed and stirred. As a result, a milky white liquid was obtained. This liquid is named as an aqueous phase 1.

Emulsification 975 parts of the pigment-wax dispersion liquid 1 and 2.6 parts of isophorone diamine as an amine were mixed using a TK Homo Mixer (manufactured by Primix Corporation) at 5000 rpm for 1 minute. Subsequently, 88 parts of the prepolymer 1 was added to the liquid and mixed using the TK Homo Mixer (manufactured by Primix Corporation) at 5000 rpm for 1 minute. Thereafter, 1200 parts of the aqueous phase 1 was added to the liquid and mixed using the TK Homo Mixer for 20 minutes while the rotating speed was adjusted in a range from 8000 to 13000 rpm. As a result, emulsified slurry 1 was obtained.

Solvent Removing

In a container provided with a stirrer and a thermometer, the emulsified slurry 1 was poured, and the solvent was removed at 30° C. for 8 hours. As a result, dispersion slurry 1 was obtained.

Washing and Drying

Then, 100 parts of the dispersion slurry 1 were filtered under reduced pressure, and the resulting filter cake was subjected to the following steps.

(1) To the filter cake, 100 parts of ion-exchanged water was added and mixed using the TK Homo Mixer (at 12000 rpm for 10 minutes), and thereafter filtered. The filtrate had a color of milky white.

(2) To the resulting filter cake after step (1), 900 parts of ion-exchanged water were added and mixed using the TK Homo Mixer (at 12000 rpm for 30 minutes) while ultra sonic vibration was applied, and thereafter filtered under reduced pressure. Step (2) was repeated such that electric conductivity of a reslurry solution was equal to or smaller than 10 μC/cm.

(3) To the filter cake, 10% hydrochloric acid was added such that the pH of the reslurry solution at step (2) stands at 4, and stirred by a three-one motor for 30 minutes and thereafter filtered.

(4) To the filter cake after step (3), 100 parts of ion-exchanged water was added and mixed using the TK Homo Mixer (at 12000 rpm for 10 minutes), and thereafter filtered. Step (4) was repeated such that electrical conductivity of a reslurry solution became equal to or smaller than 10 μC/cm. As a result, a filter cake 1 was obtained.

The filter cake 1 was dried at 42° C. for 48 hours using a wind circulation dryer, and sieved using a mesh with a sieve mesh size of 75 μm. As a result, toner base particles 101 were obtained. The toner base particles had an average circularity of 0.974, a volume average particle diameter (Dv) of 6.3 μm, and a number average particle diameter (Dp) of 5.3 μm, and the particle distribution thereof was a ratio Dv/Dp of 1.19. The toner base particles thus obtained was mixed with commercially supplied silica fine powder using a Henschel mixer, and the mixture was sieved using a mesh with a sieve mesh size of 60 μm to remove large-sized particles and agglomerates. As a result, toner was obtained.

Preparation of Toner 1

Toner 1 to which silicone oil treated silica was added was obtained by the following manner. To 100 parts of the toner base particles obtained by the above-described method, 1 part of a silica fine powder H20TM, which is commercially supplied by Clariant and has a primary average particle diameter of 12 nm and to which no silicone oil treatment had been performed, 2 parts of RY50, which is manufactured by Nippon Aerosil Co., Ltd. and has a primary average particle diameter of 40 nm and to which silicone oil treatment had been performed, were added, and the resultant material was mixed using a Henschel mixer. Thereafter, the mixture was sieved with a mesh with opening of 60 μm to remove large-sized particles and agglomerates. As a result, toner 1 was obtained. Accelerated cohesion degree of the toner 1 was measured by the following procedure, and the accelerated cohesion degree was 54.4%.

Preparation of Toner 2

Toner 2 to which silica that had not been subjected to silicon oil treatment was only added was obtained by the following manner. To 100 parts of the toner base particles obtained by the above-described method, 1 part of a silica fine powder H20TM, which is commercially supplied by Clariant Japan and has a primary average particle diameter of 12 nm and to which no silicone oil treatment had been performed, 2 parts of RX50, which is manufactured by Nippon Aerosil Co., Ltd. and has a primary average particle diameter of 40 nm and to which silicone oil treatment had not been performed, were added, and the resultant material was mixed using a Henschel mixer. Thereafter, the mixture was sieved using a mesh with a sieve mesh size of 60 μm to remove large-sized particles and agglomerates. As a result, toner 2 was obtained. The accelerated cohesion degree of the toner 2 was measured by the following procedure, and the accelerated cohesion degree was 40.3%.

Measurement Method of Accelerated Cohesion Degree

The accelerated cohesion degree of the toner 1 and the toner 2 is measured by the following manner. The accelerated cohesion degree is an index representing cohesiveness of powder. When powder is toner, the accelerated cohesion degree represents adhesivity between toner particles. A large value of the cohesion degree means that the adhesivity between toner particles is large. As a result, toner flying property in developing deteriorates. In contrast, when the value of the cohesion degree is small, background smear occurs easily. Generally, the cohesion degree is preferably equal to or smaller than 15 (refer to Japanese Patent Application Laid-open No. H07-181747).

The cohesion degree is measured by the following manner. Sieving members arranged vertically in a plurality of stages are vibrated at a predetermined amplitude in the vertical direction. A predetermined amount of powder supplied on the sieving member at the uppermost stage is dropped and dispersed in the respective sieving members by the vibration. After predetermined vibration time elapses, the cohesion degree is determined on the basis of the amount of powder dispersed on each sieving member. In the embodiments, the Powder Tester for cohesion degree measurement manufactured by Hosokawa Micron Corporation is used. On the vibration table of the Powder Tester, a vibro chute, a packing, a space ring, sieving members (three types), and a presser bar, which are accessories, are set in this order. Those parts are fixed with a knob nut and the vibration table starts vibration to measure the accelerated cohesion degree.

The sieving members are a top stage sieving member having the largest sieve mesh size; a middle stage sieving member having a medium sieving mesh size; and a bottom stage sieving member having the smallest sieving mesh size. The top stage sieving member having a mesh with a sieve mesh size of 75 μm, the middle stage sieving member having a mesh with a sieve mesh size of 45 μm, and the bottom stage sieving member having a mesh with a sieve mesh size of 20 μm. The amplitude of vibration of the sieving members is 1 mm in the vertical direction. The amount of toner used as a specimen is 2 g. The vibration time is 10 seconds. After the vibration is completed by the above-described procedure, toner on each sieving member is weighted. Thereafter, the accelerated cohesion degree is obtained in the flowing manner. The weight percentages are weighted (refer to (a) to (c)). Then, the accelerated cohesion degree (%) is obtained as a sum of the weighted values (refer to (d)).

(a) A weight percentage of powder remaining on the top stage sieving member×1. (b) A weight percentage of powder remaining on the middle stage sieving member×0.6. (c) A weight percentage of powder remaining on the bottom stage sieving member×0.2. (d) The accelerated cohesion degree (%) is the sum of the calculated values obtained at (a) to (c).

First Embodiment

Figure 3:
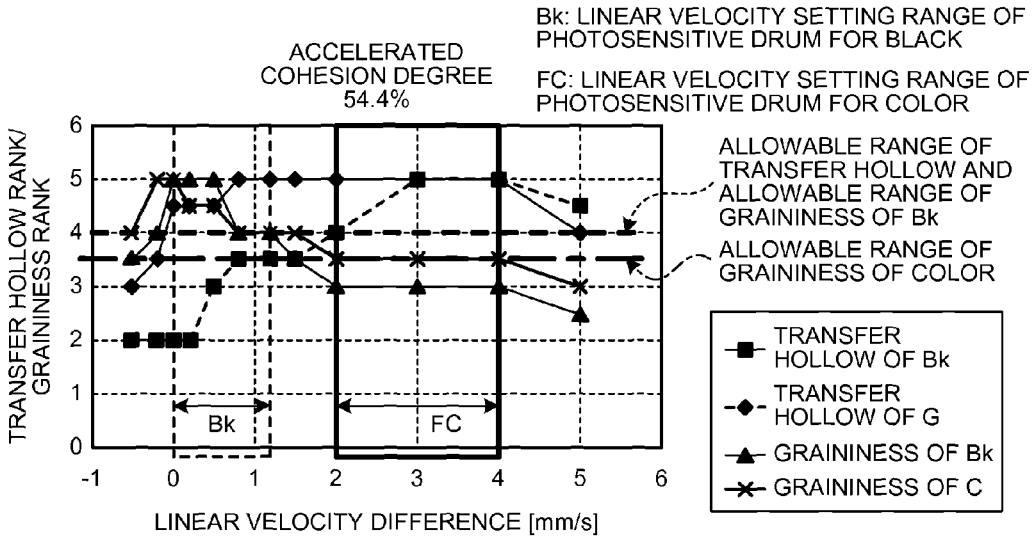
FIG. 3 is a graph illustrating ranks of transfer hollow property and graininess property relating to the image forming apparatus in a first embodiment.

A first embodiment is described below. FIG. 3 is a graph illustrating experimental results of an effect of the linear velocity difference on the transfer hollow (single-color black (Bk) and green (G)) and the graininess (single-color black (Bk) and cyan (C)) using the toner 1 having an accelerated cohesion degree of 54.4%.

The abscissa axis of FIG. 3 represents the linear velocity difference ($S_V$–$S_D$) between a surface linear velocity $S_V$ of the intermediate transfer belt 8 and a surface linear velocity $S_D$ of the photosensitive drum 2. At the point indicated as "0" in the abscissa axis, the linear velocity difference is zero. In a plus region on the right side of the point, the linear velocity of the photosensitive drum 2 is slower than that of the intermediate transfer belt 8 ($S_V$>$S_D$). The ordinate axis of FIG. 3 represents ranks of transfer hollow property and graininess property. The higher the rank, the better the transfer hollow property and the better the graininess property.

Figure 4:
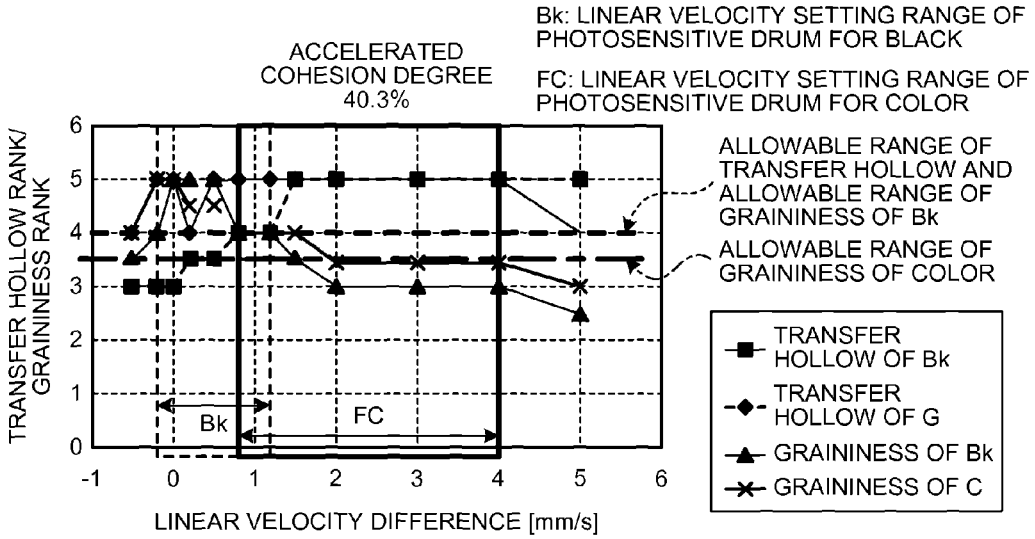
FIG. 4 is a graph illustrating ranks of the transfer hollow schematic and the graininess schematic relating to the image forming apparatus in a comparative example.

FIG. 4 is a graph illustrating experimental results of a comparative example using the toner 2 having an accelerated cohesion degree of 40.3% in the same display manner as FIG. 3.

The embodiment does not pay attention to the ratio in linear velocity between the photosensitive drum 2 and the intermediate transfer belt 8, but pays attention to the "linear velocity difference" between them in order to prevent the occurrence of the transfer hollow. The reason is that it is important to grasp how much amount of toner moves to the primary transfer nip and is output from the primary transfer nip per unit time because the transfer hollow markedly depends on how much toner on the photosensitive drum is agglutinated. Hence, attention is not paid on the ratio in linear velocity between the photosensitive drum 2 and the intermediate transfer belt 8, but is paid on the difference between the linear velocities.

As for the transfer hollow property, rank 4 or above is an allowable range for both black and color. As for the graininess property, rank 4 or above is an allowable range for black as the same rank as the transfer hollow property while rank 3.5 or above is an allowable range for color. The reason why the allowable range of the graininess property for black is rank 4 or above is that the graininess of black is readily noticed. In contrast, the graininess of color is not so much noticed as black, and thus the allowable range is set to rank 3.5 or above.

As can be seen from FIGS. 3 and 4, the toner 1 having an accelerated cohesion degree of 54.4% illustrated in FIG. 3 and the toner 2 having an accelerated cohesion degree of 40.3% illustrated in FIG. 4 differ in the linear velocity difference range in relation to allowable ranges (ranks) of the transfer hollow property and the graininess property. Specifically, when the toner 1 having high accelerated cohesion degree is used as illustrated in FIG. 3, the linear velocity difference range in relation to the allowable range of black does not much differ from that when the toner 2 having low accelerated cohesion degree is used as illustrated in FIG. 4. However, the upper and lower values of the linear velocity difference corresponding to the allowable range are shifted (the lower limit value of the linear velocity difference corresponding to the allowable range is shifted from −0.2 mm/s to 0 mm/s while the upper limit value of the linear velocity difference corresponding to the allowable range is shifted from 1.0 mm/s to 1.2 mm/s). In contrast, the upper limit value of the linear velocity difference corresponding to the allowable range for color does not change between FIGS. 3 and 4 (4.0 mm/s), but the lower limit value of the linear velocity difference corresponding to the allowable range markedly increases in FIG. 3 as compared with FIG. 4 (shifted from 0.8 mm/s to 2.0 mm/s).

The embodiment can achieve the downsizing, the longer operating life, and the low cost of the image forming apparatus by increasing the accelerated cohesion degree of toner to be equal to or larger than 54%, and also effectively prevent the occurrence of the transfer hollow by controlling the linear velocity difference in a narrow range as described above in a good balanced manner.

The optimum linear velocity difference differs in black Bk and green G obtained by overlapping toner of two colors (yellow Y and cyan C). Toner having an accelerated cohesion degree of equal to or larger than 54.4% is used in the embodiment and the rank of transfer hollow property can be achieved at rank 4 or above both black and color by setting the linear velocity difference to 0 mm/s to 1.0 mm/s for black Bk and 2.1 mm/s to 4.0 mm/s for color. Specifically, the rank of black Bk is 4.5 at the lower limit and is 5.0 at the upper limit of the linear velocity difference while the rank of color is 4.0 at the lower limit and is 5.0 at the upper limit of the linear velocity difference.

When the toner 1 having an accelerated cohesion degree of 54.4% was used without setting the linear velocity difference, the rank of the transfer hollow property was 4.5 for black and was 2 for color. In the case where the rank of the transfer hollow property of black is 4.5 at a linear velocity difference of "0", toner is new. As toner deteriorates, the accelerated cohesion degree increases, resulting in the transfer hollow rank gradually lowering from 4.5 with an increase in running distance of the photosensitive drum 2. When the toner 2 having an accelerated cohesion degree of 40.3% was used without setting the linear velocity difference, the rank of the transfer hollow property was 5 for black and was 3 for color.

Arrangement of Photosensitive Drums

Figure 5:
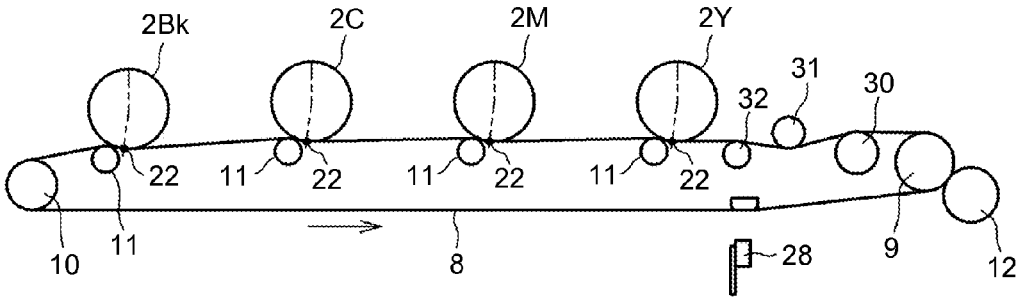
FIG. 5 is a side view of an intermediate transfer belt.

FIG. 5 illustrates an arrangement of four photosensitive drums 2 on the intermediate transfer belt 8. The belt cleaning device 13 illustrated in FIG. 1 is omitted in FIG. 5. The primary transfer rollers 11 in FIG. 5 are inexpensive metallic rollers and arranged by the indirect applying scheme in which the primary transfer rollers 11 are disposed off the centers of the respective photosensitive drums 2. Accordingly, the primary transfer nips 22 are formed between the intermediate transfer belt 8 and the respective photosensitive drums 2. The indirect applying scheme is more effective as a counter measure for preventing the transfer hollow because this scheme can distribute the primary transfer pressure.

As illustrated in FIG. 5, the photosensitive drum 2Bk for black is disposed at the most downstream position in the rotational direction of the intermediate transfer belt 8. If the photosensitive drum 2Bk for black is disposed at the most upstream position, which is the right end in FIG. 5, the occurrence of the transfer hollow is promoted because the primarily transferred black on the intermediate transfer belt 8 is transferred to photosensitive drums 2Y, 2M, and 2C (reverse transfer phenomenon) when passing through the photosensitive drums 2Y, 2M, and 2C arranged downstream from the photosensitive drum 2Bk for black.

Therefore, it is advantageous to dispose the photosensitive drum 2Bk for black at the most downstream position because the transfer hollow hardly occurs. In addition, the photosensitive drum 2Bk for black disposed at the most downstream position as described above is advantageous because the transfer hollow of black is most noticeable among the colors. The transfer hollows of colors can be less noticeable by overlapping black with suppressed transfer hollow at the most downstream position when taking the occurrence of the transfer hollows of colors at primary transfer in the upper stream of the photosensitive drum 2Bk into consideration.

The photosensitive drum 2Y for yellow is disposed at the most upstream position in the rotational (moving) direction of the intermediate transfer belt 8 in FIG. 5. While this position most adversely affects the transfer hollow, the photosensitive drum 2Y for yellow is preferably disposed at this position because the transfer hollow of yellow is not noticeable in colors. In addition, it is known that toner transferred to the intermediate transfer belt 8 at the most upstream position is scattered when passing through the photosensitive drums 2 positioned downstream by discharge caused by a potential difference between the intermediate transfer belt 8 and the respective photosensitive drums 2, and the graininess property deteriorates. Taking such property deterioration into consideration, it is reasonable to dispose the photosensitive drum 2 for yellow at the most upstream position and the photosensitive drum 2 for black at the most downstream position.

In terms of the graininess of black, it is advantageous that the photosensitive drum 2Bk for black is disposed at the most downstream position because the intermediate transfer belt 8 passes no primary transfer nip after the photosensitive drum 2Bk for black, which does not cause toner on the intermediate transfer belt 8 to be physically compressed before being secondarily transferred or does not cause toner images to be deteriorated by discharge from the intermediate transfer belt 8.

In the image forming apparatus according to the embodiment, the toner images on the photosensitive drums 2Y, 2C, 2M, and 2Bk are transferred (primarily transferred) to the intermediate transfer belt 8, and thereafter the toner images on the intermediate transfer belt 8 are transferred (secondarily transferred) to the recording medium S with the secondary transfer roller 12. The image forming apparatus further includes an optical detection sensor 28 (e.g., a reflective photo sensor composed of a light-emitting element and a light receiving element) that detects an image adjusting pattern and faces the surface of the intermediate transfer belt 8.

The detection sensor 28 detects the amount of toner stuck on the intermediate transfer belt 8. Specifically, toner sticking patterns (image adjusting patterns) are formed in non-image areas on the photosensitive drums 2Y, 2C, 2M, and 2Bk and the toner sticking patterns are primarily transferred onto the intermediate transfer belt 8. The detection sensor 28 detects the amount of the toner stuck on the image adjusting patterns. Image forming conditions for a next image are changed on the basis of the information detected by the detection sensor 28. A control unit including a micro computer (MPU) or a central processing unit (CPU) performs process control so as to form appropriate images or optimizes a supply amount of toner for toner concentration control.

Three rollers 30, 31, and 32 having different sizes in diameter, i.e., large, medium, and small, are arranged near the driving roller 9 on the downstream side of the driving roller 9. The roller 31 disposed at the middle position for reverse bending guides the intermediate transfer belt 8 so as to push down the intermediate transfer belt 8. The reverse bending roller 31 bends the intermediate transfer belt 8, which has got deformed in an upward convex shape between the driving roller 9 and the secondary transfer roller 12, in a direction opposite the deformed direction, and thereby enhancing the flatness of the intermediate transfer belt 8. As a result, toner transferred on the intermediate transfer belt 8 is prevented from being peeled when the intermediate transfer belt 8 passes through the respective photosensitive drums 2.

Second Embodiment

A second embodiment is described below. In the second embodiment, the linear velocity of the photosensitive drum is controlled with time to be reduced in accordance with a pattern as illustrated in FIG. 6. For a test to confirm effects of the velocity reduction control on the transfer hollow and the abrasion of the belt, a color printer (IPSiO SP C310 manufactured by Ricoh Company, Ltd.) was modified such that the process units and the toner cartridges were attachable to the printer.

The process units were connected to an image forming driving motor of the color printer. As for the driving of the toner cartridges, a clutch enabled the driving source of the process units to connect to the toner cartridges. Toner was able to be supplied by connecting the driving source and the driving gears of the toner cartridges if needed. Toner used in the test was the same as the toner 1 (having an accelerated cohesion degree of 54.4%). For confirmation of the effects, control was made in the following example 1 and comparative examples 1 to 3.

Control in Example 1

The toner 1 was used and was supplied as supplementary supply. The linear velocity of the photosensitive drum (circumferential velocity of the photosensitive drum) was controlled so as to be changed as illustrated in FIG. 6 in accordance with the deterioration of the toner and the running distance of the photosensitive drum (or the transfer belt) for black and each color. The surface resistance of the belt used in the test was $3.0\times10^{10}$ Ω/square. The primary transfer bias was 1100 V. The primary transfer pushing force was 17 N. As a durability condition, 80000 sheets were subjected to be printed.

Control in Comparative Example 1

The control of the linear velocity of the photosensitive drum for black and each color was changed from that in example 1 such that the linear velocities of them were equal to that of the intermediate transfer belt (140 mm/s). The other conditions were the same as those of example 1.

Control in Comparative Example 2

The control of the linear velocity of the photosensitive drum for black and each color was changed from that in example 1 such that the linear velocities of them (136.0 mm/s)

were smaller than that of the intermediate transfer belt by 4.0 mm/s. The other conditions were the same as those of example 1.

Control in Comparative Example 3

The pushing force of the primary transfer roller for black and each color was changed to 27 N from that in example 1. The other conditions were the same as those of example 1.

The linear velocities of the photosensitive drums 2 were controlled under the above-described conditions, and evaluation results and comprehensive evaluation results of example 1 and comparative examples 1 to 3 were obtained as illustrated in FIG. 7.

Evaluation Criteria on Transfer Hollow

A character image formed by overlapping two colors was output and the presence or absence of the transfer hollow was determined by the criteria whether toner on the output image was missing at the central area of the image.

Fail: toner was missing

Pass: no toner was missing

Evaluation Criteria on Abrasion of Belt

A solid image was output and the presence or absence of the abrasion of the intermediate transfer belt 8 was determined by the criteria whether vertical lines appeared on the output image.

Fail: vertical lines appeared on the output image

Pass: no vertical lines appeared on the output image

Evaluation Criteria on Comprehensive Evaluation

The comprehensive evaluation was determined as "pass" when both of the transfer hollow and the durability of the belt were evaluated as "pass". The comprehensive evaluation was determined as "fail" when either or both of the transfer hollow and the durability of the belt were evaluated as "fail".

It was confirmed that the transfer hollow was effectively able to be prevented while the graininess of images was maintained at a high level by the following manner. The linear velocity differences between the photosensitive drum 2 and the intermediate transfer belt 8 are denoted by $X_1$ for black and $X_2$ for color. They are changed so as to increase while satisfying a relation of $0<X_1\leq 1.2$ mm/sec and a relation of $2.1\leq X_2\leq 4.0$ mm/sec in accordance with the running distance of the photosensitive drum 2 or the deterioration degree of toner from time of toner supply.

The temporal control of the linear velocity of the photosensitive drum 2 thus described causes the linear velocity of the intermediate transfer belt 8 to be relatively faster than that of the photosensitive drum 2 even though the cohesiveness of toner increases due to the deterioration of the toner. This linear velocity difference causes mechanical sticking force of toner to the intermediate transfer belt 8 to increase, thereby promoting transfer effect of toner to the intermediate transfer belt 8 even when toner having a high cohesiveness is used. As a result, the transfer hollow can be effectively prevented.

In addition, the graininess can be optimized depending on the condition and deterioration level of toner in the developing device 4 by controlling the linear velocity of the photosensitive drum 2 to increase to be equal to the linear velocity of the intermediate transfer belt 8 in synchronization with the toner supply from the toner cartridge.

Modification of Intermediate Transfer Belt

FIG. 8 illustrates a multilayered structure of the intermediate transfer belt 8. The intermediate transfer belt 8 is composed of a base member 8*a* made of thermoplastic elastomer and an acryl coating layer 8*b* formed by being applied on a surface of the base member 8*a* as a releasing layer. The acryl coating layer 8*b*, which enhances releasing performance of toner from the intermediate transfer belt 8 in the secondary transfer nip, is formed by being applied with a thickness of 1.5 μm to 3 μm. The acryl coating layer 8*b* enhances the releasing performance of toner in the secondary transfer nip, but causes the reverse transfer to the photosensitive drum 2 to readily occur in the primary transfer nip due to the releasing performance.

When the linear velocity of the photosensitive drum 2 is close to that of the intermediate transfer belt 8, i.e., the linear velocity difference is small. This is disadvantageous for the prevention of the transfer hollow. However, the transfer hollow can be effectively prevented by setting the linear velocities of the photosensitive drums 2 for black and each color such that the linear velocity difference is in the respective appropriate ranges as described above.

The invention is not limited to the embodiments and various modifications can be made. For example, a revolver type in which a plurality of photosensitive drums and the primary transfer unit are moved by being rotated may be employed while a tandem type in which the photosensitive drums 2 are disposed on the intermediate transfer belt 8 is exemplified in the embodiments. As another example, a structure may be employed in which a single photosensitive drum and a single primary transfer unit are provided, and a plurality of colors are charged, developed, and transferred on an intermediate transfer body through a common transfer body.

The use of toner having an accelerated cohesion degree of equal to or larger than 54% with the lubricating component such as silicone oil does not require the lubricant applying unit to be disposed in the vicinity of the image carrier, thereby readily downsizing the image forming apparatus.

The setting of the linear velocity difference between the image carrier and the intermediate transfer body causes a shearing force to act on the toner in the primary transfer nip at which the image carrier and the intermediate transfer body make contact with each other. The shearing force causes the toner layer to crumble before the toner in the primary transfer nip is pressed and packed, thereby promoting the transfer effect. In addition, the toner layer in the primary transfer nip is formed as a thin layer because the velocity of the intermediate transfer body is faster than that of the image carrier. Consequently, the transfer hollow property and graininess property are improved by the effective transfer effect.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A color image forming apparatus, comprising:

a plurality of image carriers that form a toner image of black and toner images of a plurality of colors excluding black by electrophotography based on image information, and carry the toner images;

an intermediate transfer body that makes contact with the image carriers; and a primary transfer unit that transfers the toner images on the image carriers to the intermediate transfer body, wherein a line velocity difference is set between the image carriers and the intermediate transfer body, an accelerated cohesion degree of toner is equal to or larger than 54%, a linear velocity difference $X_1$ between the image carrier for black and the intermediate transfer body satisfies a relation of $0<X_1\leq 1.2$ mm/sec within which the linear velocity of the image carrier for black is smaller than the linear velocity of the intermediate transfer body, and a linear velocity difference $X_2$ between the image carriers for the colors except the black and the intermediate transfer body satisfies a relation of $2.1 \leq X_2 \leq 4.0$ mm/sec within which the linear velocities of the image carriers for the colors are smaller than the linear velocity of the intermediate transfer body.

2. The color image forming apparatus according to claim 1, wherein, with deterioration of the toner, the linear velocity differences $X_1$ and $X_2$ between the image carriers and the intermediate transfer body are increased in the respective relations.

3. The color image forming apparatus according to claim 2, wherein the color image forming apparatus is capable of being provided with a toner cartridge for toner supply, and timing to change the linear velocity differences $X_1$ and $X_2$ between the image carriers and the intermediate transfer body in accordance with running distances of the image carriers is synchronized with timing to supply toner from the toner cartridge.

4. The color image forming apparatus according to claim 3, wherein, when the toner is supplied from the toner cartridge, the linear velocity differences $X_1$ and $X_2$ are set to be minimum values, and the linear velocity differences $X_1$ and $X_2$ are changed to be increased by B mm/sec for each running distance of A km in the running distances of the image carriers starting from the timing of the toner supply on the basis of a calculation equation of $B=A\times0.5$ where $0 \leq |B| \leq 4.0$ and a maximum value of B is 4.0.

5. The color image forming apparatus according to claim 1, wherein the image carriers for the colors include the image carriers for yellow, magenta, and cyan, and the image carrier for yellow is disposed at a most upstream position and the image carrier for black is disposed at a most downstream position in the image carriers arranged along the intermediate transfer body.

6. The color image forming apparatus according to claim 1, wherein a common driving unit is provided to the image carriers for the colors and another driving unit is provided to the image carrier for black separate from the common driving unit.

7. The color image forming apparatus according to claim 1, wherein the intermediate transfer body has a releasing layer as a surface layer of the intermediate transfer body.

8. The color image forming apparatus according to claim 1, wherein the intermediate transfer body is of an intermediate transfer belt, a cleaning unit of the intermediate transfer belt has a cleaning blade and a metallic roller, and toner remaining on a surface of the intermediate transfer belt is removed by passing the intermediate transfer belt in a space between the cleaning blade and the metallic roller.

9. The color image forming apparatus according to claim 1, wherein the intermediate transfer body is of an intermediate transfer belt, the color image forming apparatus further comprises a reverse bending roller that is disposed upstream from a belt cleaning blade for the intermediate transfer belt such that the reverse bending roller pushes down the intermediate transfer belt.

10. The color image forming apparatus according to claim 1, further comprising a developer container having toner therein, the toner being a lubricating toner.

* * * * *